US006957852B1

(12) United States Patent
Hsieh

(10) Patent No.: US 6,957,852 B1
(45) Date of Patent: Oct. 25, 2005

(54) FOLDABLE FURNITURE DEVICE

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 10/995,423

(22) Filed: Nov. 24, 2004

(51) Int. Cl.[7] ..... A47C 4/00; A47C 4/44; A47C 4/48

(52) U.S. Cl. ..... 297/46; 297/19; 297/46; 297/56

(58) Field of Search ..... 297/16.1, 19, 21, 297/27, 34, 38, 46, 56, 58; 108/118, 119, 108/120

(56) References Cited

U.S. PATENT DOCUMENTS 4,867,505 A * 9/1989 Parker ..... 297/27
6,332,646 B1 * 12/2001 Tseng ..... 297/16.1
6,824,207 B1 * 11/2004 Lin ..... 297/16.1
6,840,573 B1 * 1/2005 Yao ..... 297/16.1
6,883,862 B1 * 4/2005 Yao ..... 297/16.1
2004/0245810 A1 * 12/2004 Tseng ..... 297/56

* cited by examiner

*Primary Examiner*—Anthony D. Barfield
(74) *Attorney, Agent, or Firm*—Davidson Berquist Jackson & Gowdey LLP

(57) ABSTRACT

A furniture device includes first and second leg frames pivotally connected to a main frame, and a slide rod inserted into and movable within the second leg frame. The second leg frame includes an elongate slot having first and second ends respectively proximate to and distal from the top end of the second leg frame. A securing unit has a fastening element extending through the slot and the slide rod and fixed to the main frame, and is operable to slide the fastening element to the first and second ends of the slot in unfolded and folded states of the furniture device, respectively. A locking unit is provided to lock the slide rod against movement when the fastening element moves to the first end of the slot.

5 Claims, 6 Drawing Sheets

FOLDABLE FURNITURE DEVICE

BACKGROUND OF THE INVENTION

1. Field of the Invention

The invention relates to a furniture device, more particularly to a foldable furniture device, such as a foldable chair.

2. Description of the Related Art

Referring to FIG. 1, a conventional foldable chair assembly 7 includes a leg frame 8 and a seat member 9. The leg frame 8 includes two intersecting U-shaped legs 81, each of which has front and rear leg sections 83, 84. The seat member 9 is connected between top ends of the front and rear leg sections 83, 84. The front leg sections 83 of the U-shaped legs 81 are connected pivotally to each other by a pivot member 85, and are interconnected by a cross bar 86. The rear leg sections 84 of the U-shaped legs 81 are connected pivotally to each other by another pivot member (not visible), and are interconnected by another cross bar 86'. Each of the cross bars 86, 86' can be folded and unfolded. When unfolded, each cross bar 86, 86' forms a straight line so as to position the U-shaped legs 81 in an unfolded state.

However, the user may easily injure his/her hand during the folding operation of the cross bars 86, 86', i.e., the user's fingers may be pinched by the cross bars 86, 86'. Hence, there is a need to provide a foldable chair assembly with a more simple, safe, and reliable structure.

SUMMARY OF THE INVENTION

Therefore, the object of the present invention is to provide a foldable furniture device that can be easily folded and unfolded.

According to this invention, a foldable furniture device comprises a main frame, first and second leg frames, a slide rod, a securing unit, and a locking unit. The first and second leg frames are connected pivotably to each other to move between a folded state and an unfolded state. The first leg frame has a top end pivotally connected to the main frame, and a bottom end. The second leg frame has a top end connected pivotally to the main frame, and a bottom end. The second leg frame includes an elongate slot that extends along a longitudinal direction of the second leg frame and that has a first end proximate to the top end of the second leg frame, and a second end distal from the top end of the second leg frame. The slide rod is inserted into and is movable within the second leg frame. The securing unit is provided for connecting the second leg frame to the main frame, and has a fastening element that extends through the slot and the slide rod and fixed to the main frame. The securing unit is operable to slide the fastening element to the first end of the slot in the unfolded state, and to the second end of the slot in the folded state. The securing unit further moves the slide rod along with the fastening element. The locking unit is associated at least with the slide rod to lock the slide rod against movement when the fastening element moves to the first end of the slot.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
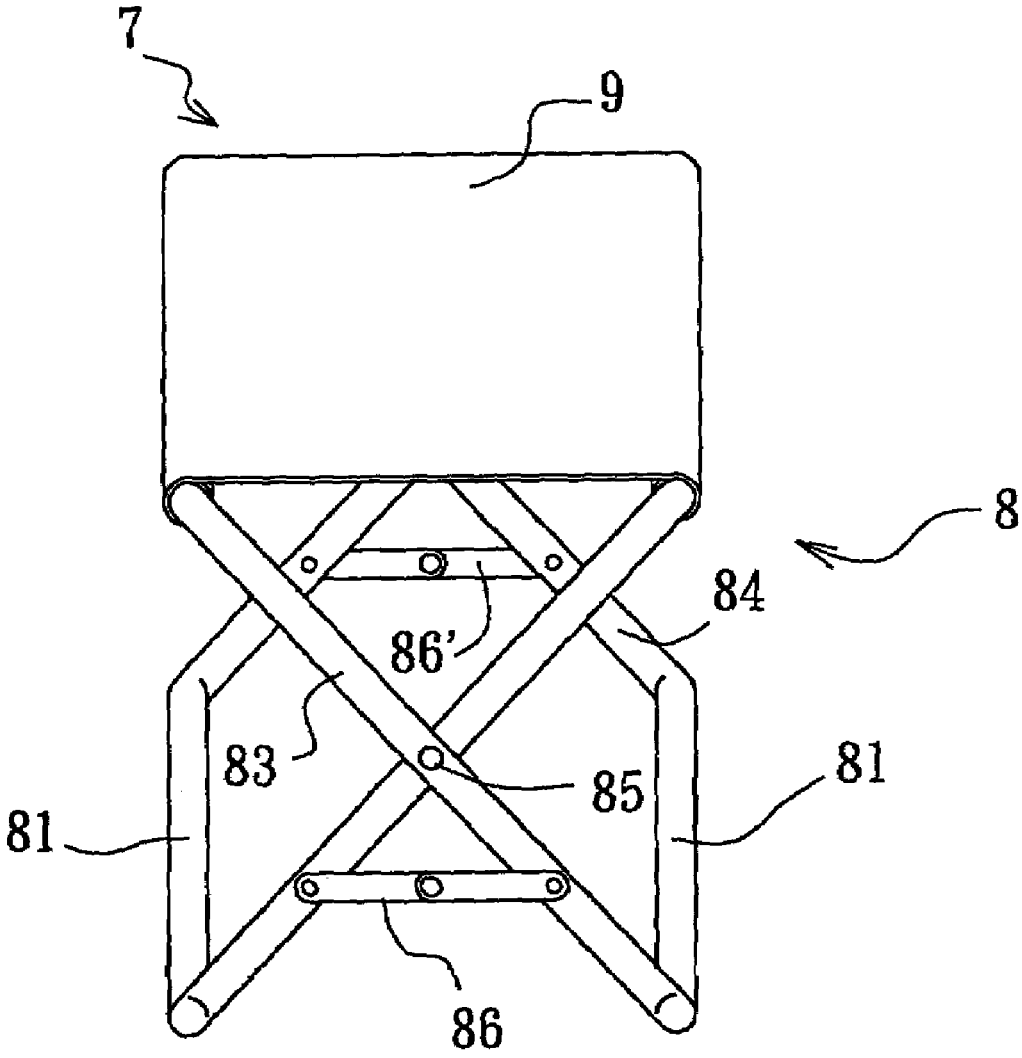
F I G. 1 PRIOR ART
FIG. 1 is a perspective view of a conventional foldable chair assembly.
Figure 2:
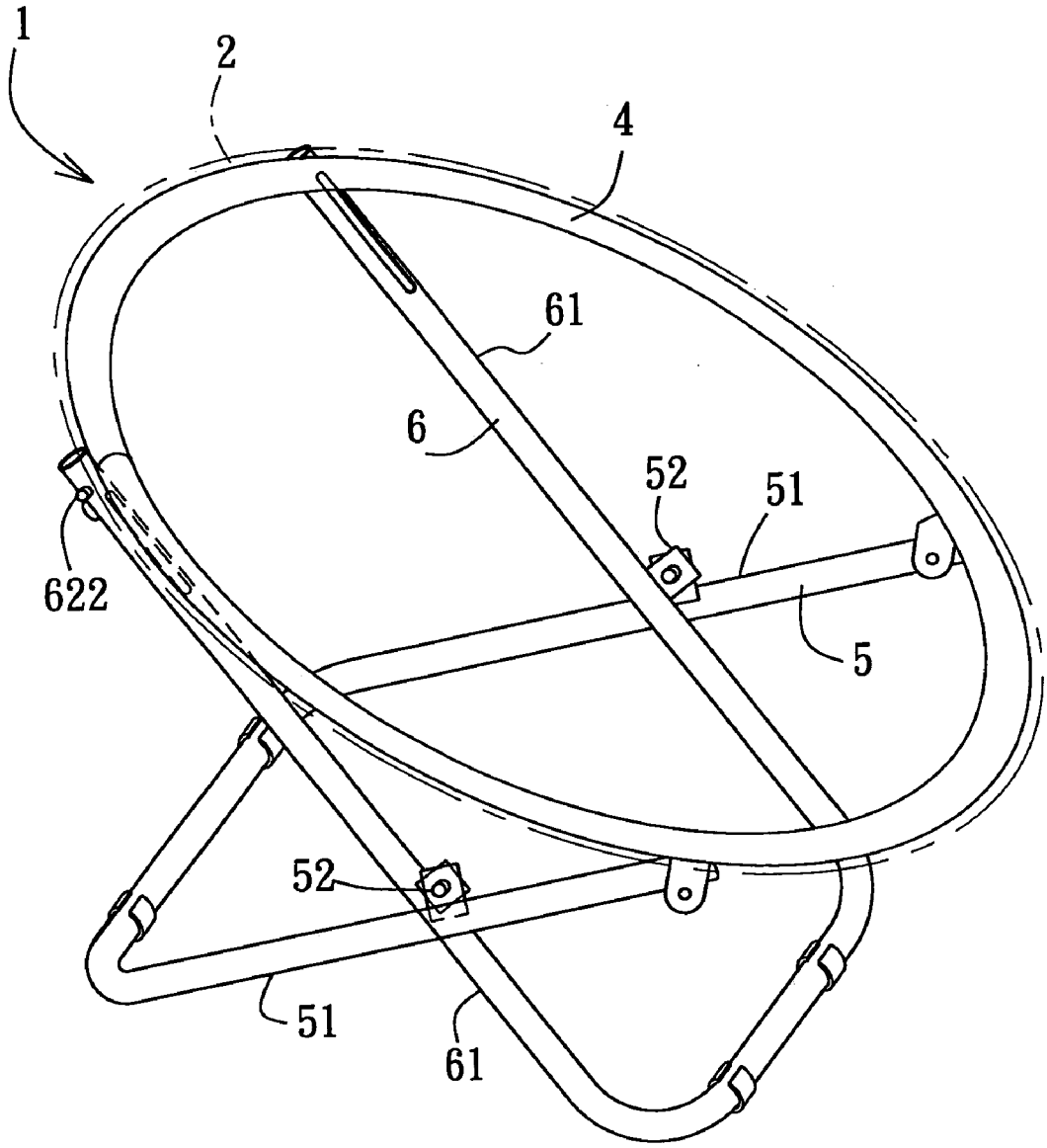
FIG. 2 is a perspective view showing a foldable chair embodying the present invention in an unfolded state.
Figure 3:
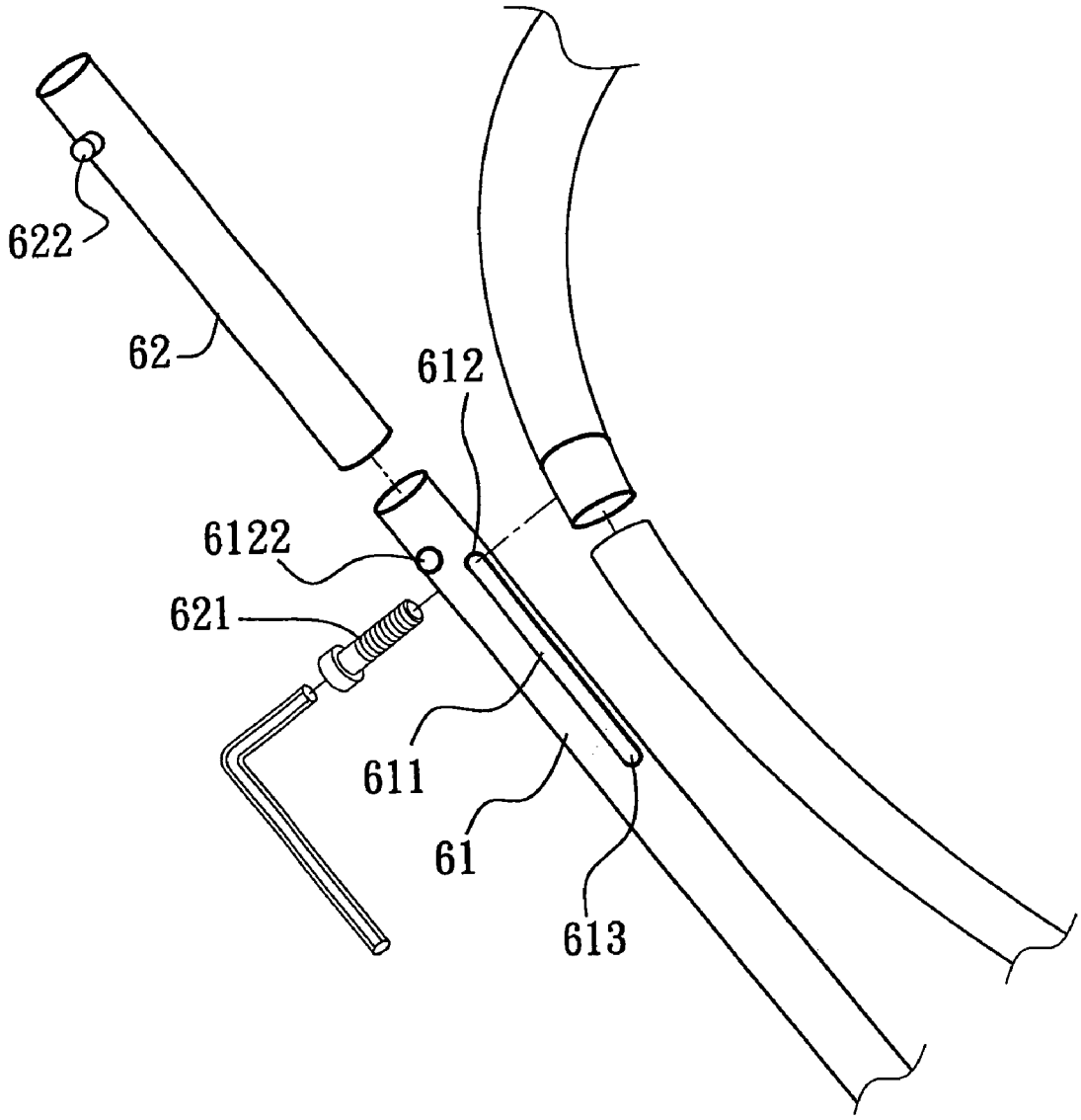
FIG. 3 is a fragmentary perspective view of the chair of FIG. 2, illustrating how a securing unit connects a second leg frame to a main frame.

Referring to FIGS. 2 and 3, the preferred embodiment of a foldable furniture device according to the present invention is shown at "1" which designates a foldable chair. The chair 1 comprises a main frame 4, a first leg frame 5, a second leg frame 6, two slide rods 62, two securing units, and two locking units.

The main frame 4 is formed as a ring-shaped frame, and includes a pliable bag 2 that envelopes the ring-shaped frame.

The first leg frame 5 is substantially U-shaped, and includes two spaced-apart first leg sections 51 which have top ends connected pivotally to the main frame 4.

The second leg frame 6 is substantially U-shaped, and includes two spaced-apart second leg sections 61 which are connected pivotally and respectively to the first leg sections 51 through pivot members 52 so that the first and second leg frames 5, 6 are movable relative to each other between a folded state and an unfolded state.

Figure 4:
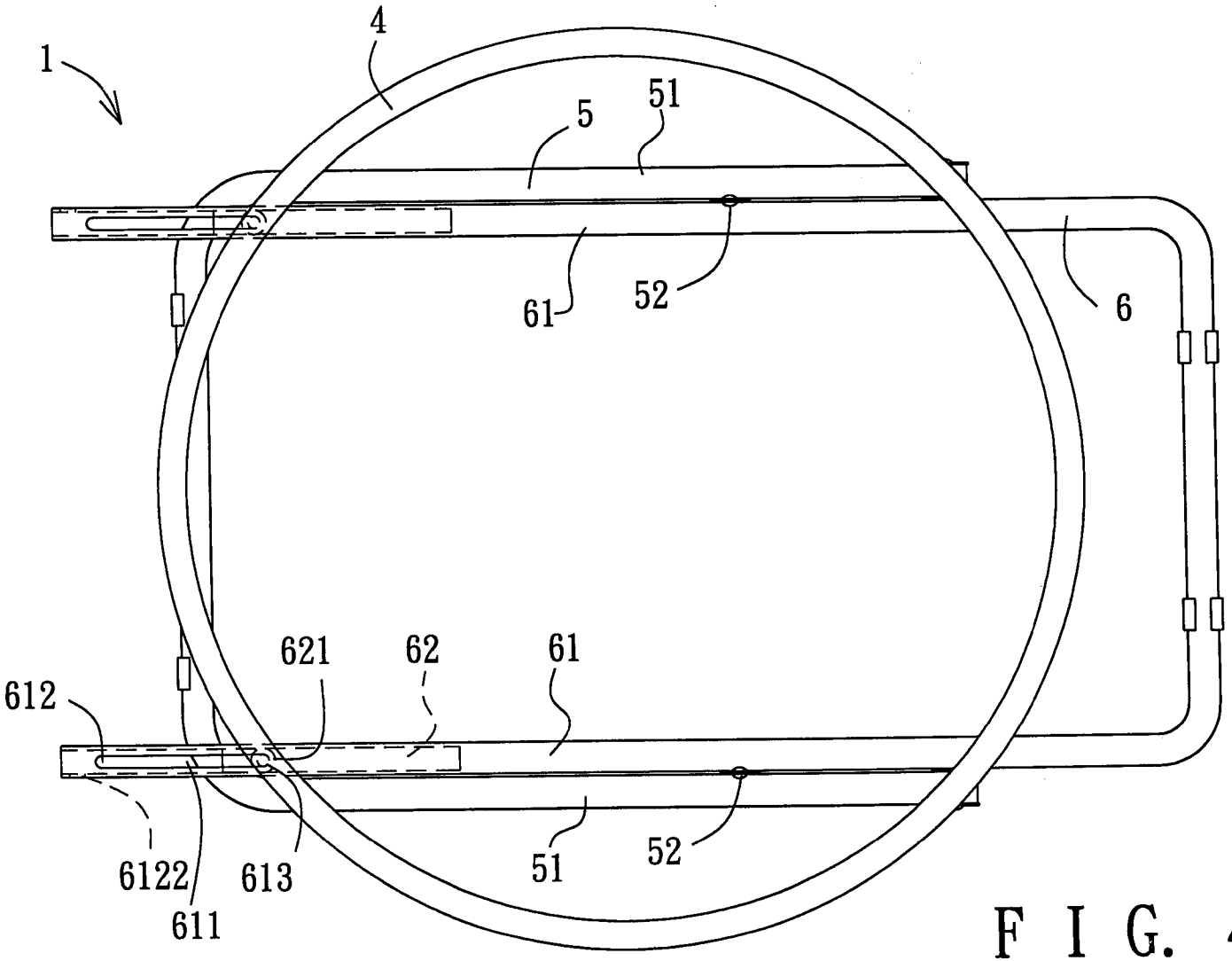
FIG. 4 is a schematic top view of the chair of FIG. 2 in a folded state.
Figure 5:
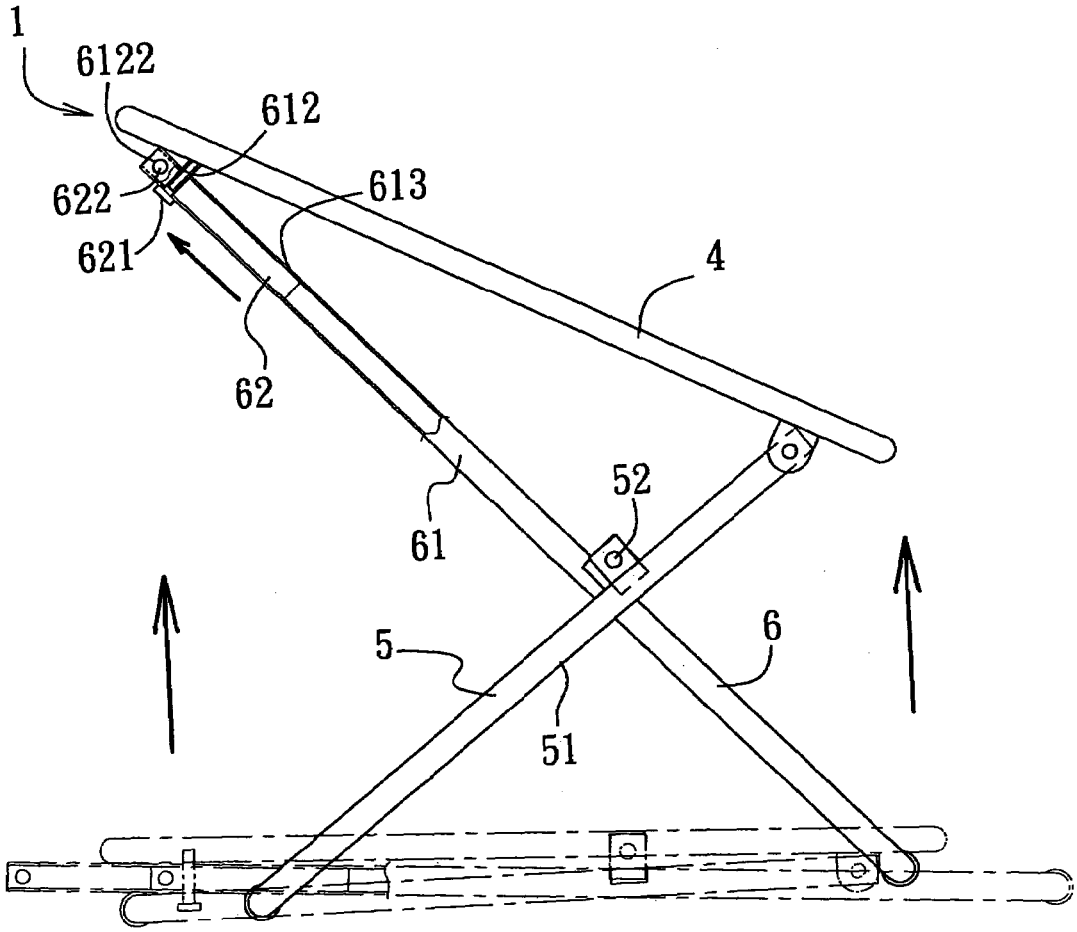
FIG. 5 is a schematic side view of the chair of FIG. 2.

Since the lengths of the first leg sections 51 are shorter than the lengths of the second leg sections 61, and since the space between the first leg sections 51 is larger than the space between the second leg sections 61, the first leg sections 51 are disposed outwardly of the second leg sections 61 when the chair 1 is folded, as shown in FIG. 4. When the chair 1 is unfolded, the first and second leg frames 5, 6 intersect each other, and support the ring-shaped main frame 4 on the ground in an inclined manner, as shown in FIGS. 2 and 5. The pliable bag 2 serves to provide a backrest and a seat for the user at this time.

The second leg sections 61 respectively include elongate slots 611 that extend along a longitudinal direction of the second leg sections 61. Each of the slots 611 has a first end 612 proximate to the top end of a respective second leg section 61, and a second end 613 distal from the top end of the respective second leg section 61.

Each of the slide rods 62 is inserted into and is movable within a respective one of the second leg sections 61.

Each of the securing units connects a respective one of the second leg sections 61 to the main frame 4, and has a fastening element 621, in the form of a screw, that extends through a respective slot 611 and a respective slide rod 62, and is fixed to the main frame 4. Each securing unit is operable such that the corresponding fastening element 621 is able to slide to the first end 612 of the respective slot 611 in the unfolded state, and to the second end 613 of the respective slot 611 in the folded state. The respective slide rod 62 moves along with the corresponding fastening element 621 during folding and unfolding of the chair 1.

The locking units may be any suitable means that can lock the slide rods 62 against movement when the fastening elements 621 of the securing units move to the first ends 612 of the slots 611. In this embodiment, each of the locking units is provided in the respective one of the second leg sections 61 and on the respective one of the slide rods 62.

That is, each locking unit of this embodiment includes a positioning hole 6122 formed in the respective second leg section 61, and a resilient protrusion 622 formed on an outer wall face of the respective slide rod 62 and engageable with the positioning hole 6122. The positioning hole 6122 is formed between the top end of the respective second leg section 61 and the first end 612 of the respective slot 611, and is out of alignment with the corresponding slot 611 along the longitudinal direction of the respective second leg section 61, as best illustrated in FIG. 3.

When the chair 1 is completely folded, as shown in FIG. 4, the main frame 4 overlies the first and second leg frames 5, 6, and the fastening element 621 of each securing unit and each slide rod 62 are located at the second end 613 of the respective slot 611.

When unfolding of the chair 1 is desired, with reference to FIG. 5, the main frame 4 together with the second leg frame 6 are pulled apart from the bottom end of the first leg frame 5, and simultaneously, the fastening element 621 of each securing unit together with the respective slide rod 62 move toward the first end 612 of the respective slot 611.

Figure 6:
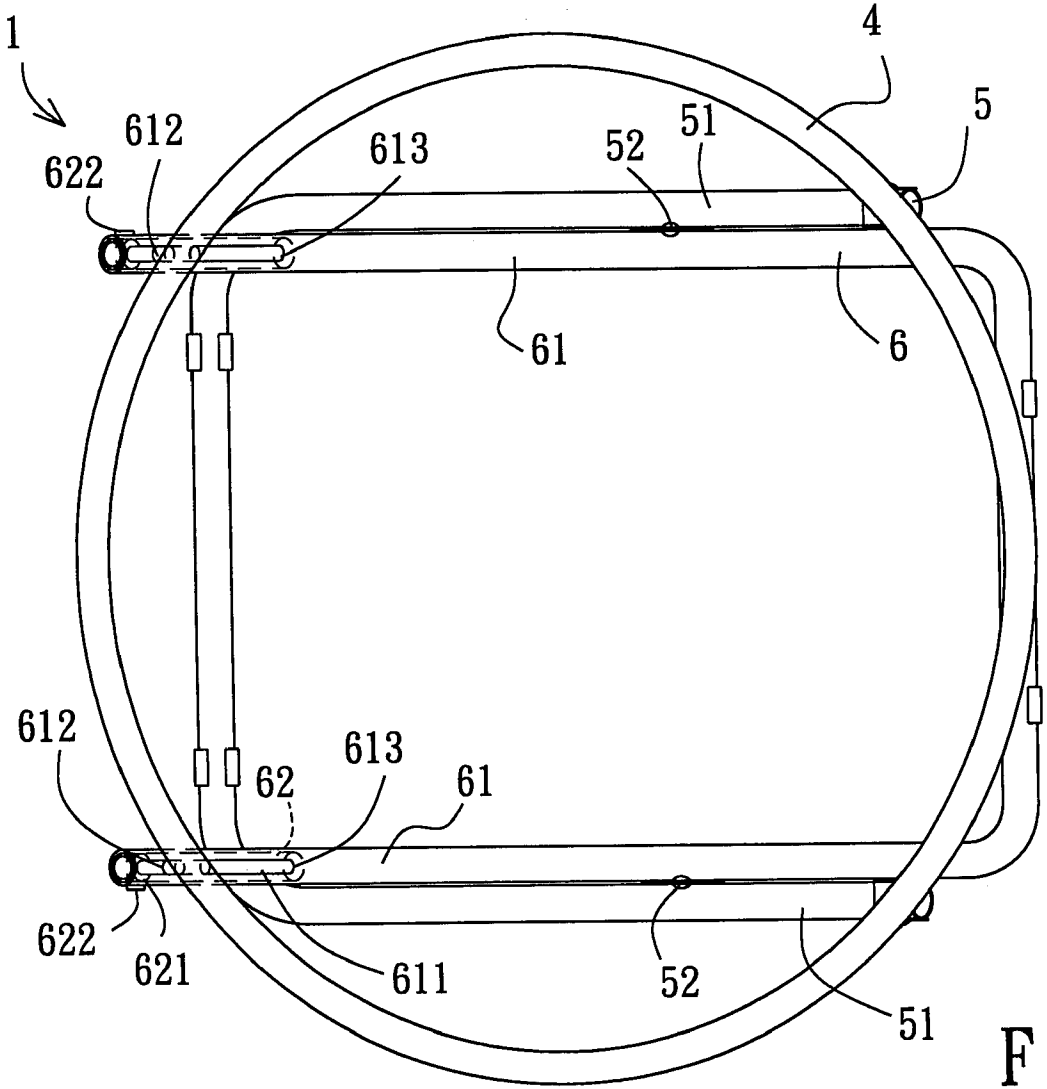
FIG. 6 is a schematic top view of the chair of FIG. 2.

Referring to FIG. 6, when the fastening element 621 of each securing unit together with the respective slide rod 62 move from the second end 613 to the first end 612 of the respective slot 611, the resilient protrusion 622 on each respective slide rod 62 engages the positioning hole 6122, in the respective second leg section 61 so that each slide rod 62 is locked against movement within the respective second leg section 61, thereby maintaining the chair 1 in the unfolded state.

When the resilient protrusion 622 on each respective slide rod 62 is disengaged from the positioning hole 6122 in the respective second leg section 61, the fastening element 621 of each securing unit together with the respective slide rod 62 move from the first end 612 to the second end 613 of the respective slot 611, and the chair 1 is folded back to the position shown in FIG. 4.

From the aforementioned description of the foldable chair 1 of the present invention, it is apparent that through the ability of the slide rods 62 to be locked to the second leg sections 61, and through the slidable movement of the fastening elements 621 of the securing, units along the slots 611, the chair 1 can be easily and safely folded and unfolded. Furthermore, since the positioning components of the chair 1 are hidden behind the main frame 4, the chair 1 is not only easy and safe to operate, but also has an appealing appearance.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable furniture device comprising;

a main frame;

first and second leg frames connected pivotably to each other to move between a folded state and an unfolded state, each of said first and second leg frames having a top end pivotally connected to said main frame, said second leg frame including an elongate slot that extends along a longitudinal direction of said second leg frame and that has a first end proximate to said top end of said second leg frame, and a second end distal from said top end of said second leg frame;

a slide rod inserted into and movable within said second leg frame;

a securing unit for connecting said second leg frame to said main frame, and having a fastening element that extends through said slot and said slide rod and fixed to said main frame, said securing unit being operable to slide said fastening element to said first end of said slot in said unfolded state, and to said second end of said slot in said folded state, said securing unit further moving said slide rod along with said fastening element; and a locking unit associated at least with said slide rod to lock said slide rod against movement when said fastening element moves to said first end of said slot.

2. The foldable furniture device as claimed in claim 1, wherein said locking unit includes a positioning hole formed in said second leg frame adjacent to said top end of said second leg frame, and a resilient protrusion formed on said slide rod and engageable with said positioning hole.

3. The foldable furniture device as claimed in claim 2, wherein said positioning hole is disposed between said top end of said second leg frame and said slot, and is out of alignment with said slot along the longitudinal direction of said second leg frame.

4. The foldable furniture device as claimed in claim 1, wherein each of said first and second leg frames is substantially U-shaped.

5. The foldable-furniture device as claimed in claim 1, wherein said main frame is formed as a ring-shaped frame, and includes a pliable bag that envelopes said ring-shaped frame, said ring-shaped frame and said pliable bag cooperatively forming a combined seat and backrest unit of a chair.

* * * * *